US005950471A

United States Patent [19]

Everlove, Jr.

[11] Patent Number: 5,950,471

[45] Date of Patent: Sep. 14, 1999

[54] VERTICAL RACK SPLINE FORMING MACHINE

[75] Inventor: James C. Everlove, Jr., Troy, Mich.

[73] Assignee: Anderson-Cook, Inc., Fraser, Mich.

[21] Appl. No.: 09/032,160

[22] Filed: Feb. 27, 1998

[51] Int. Cl.[6] ..... B21H 5/00

[52] U.S. Cl. ..... 72/88

[58] Field of Search ..... 72/88, 90, 102, 72/455

[56] References Cited

U.S. PATENT DOCUMENTS

| | | | |
|---|---|---|---|
| 382,710 | 5/1888 | Laundry . | |
| 609,201 | 8/1898 | Hathorn . | |
| 716,681 | 12/1902 | Daniels | 72/88 |
| 923,852 | 6/1909 | Kennedy | 72/447 |
| 1,266,402 | 5/1918 | Canda | 72/88 |
| 3,717,017 | 2/1973 | Vukovich | 72/68 |
| 3,793,866 | 2/1974 | Anderson | 72/88 |
| 3,804,006 | 4/1974 | Maquignaz et al. | 72/88 |
| 3,913,476 | 10/1975 | Maquignaz et al. | 72/88 |
| 4,155,236 | 5/1979 | Jungesjo | 72/88 |
| 4,270,375 | 6/1981 | Jungesjo | 72/88 |
| 4,380,918 | 4/1983 | Killop | 72/88 |
| 4,399,678 | 8/1983 | Killop | 72/88 |
| 4,467,631 | 8/1984 | Killop | 72/88 |
| 4,485,657 | 12/1984 | Ridley et al. | 72/88 |
| 4,487,047 | 12/1984 | Killop | 72/88 |
| 4,506,537 | 3/1985 | Anderson | 72/88 |
| 4,519,231 | 5/1985 | Roth | 72/88 |
| 4,545,229 | 10/1985 | Stepanenko et al. | 72/88 |
| 4,571,982 | 2/1986 | Bishop et al. | 72/400 |
| 4,574,605 | 3/1986 | Stein | 72/88 |
| 4,610,154 | 9/1986 | Carene, Jr. | 72/88 |
| 4,646,549 | 3/1987 | Saito et al. . | |
| 4,658,619 | 4/1987 | Hill | 72/88 |
| 4,677,836 | 7/1987 | Anderson et al. | 72/88 |
| 4,689,980 | 9/1987 | Killop et al. | 72/88 |
| 4,691,551 | 9/1987 | Haga et al. . | |
| 4,712,408 | 12/1987 | Killop | 72/88 |
| 4,712,409 | 12/1987 | Killop | 72/88 |
| 4,712,410 | 12/1987 | Killop | 72/88 |
| 4,729,233 | 3/1988 | Killop et al. | 72/88 |
| 4,741,191 | 5/1988 | Anderson et al. | 72/88 |
| 4,756,179 | 7/1988 | Anderson et al. | 72/88 |
| 4,756,182 | 7/1988 | Anderson et al. | 72/469 |
| 4,819,468 | 4/1989 | Anderson | 72/88 |
| 4,829,800 | 5/1989 | Killop | 72/88 |
| 4,833,905 | 5/1989 | Hill | 72/88 |
| 4,852,375 | 8/1989 | Killop et al. | 72/88 |
| 4,882,926 | 11/1989 | Anderson | 72/88 |
| 4,891,962 | 1/1990 | Anderson | 72/88 |
| 4,918,961 | 4/1990 | Hill | 72/88 |
| 4,956,986 | 9/1990 | Anderson | 72/88 |
| 5,076,086 | 12/1991 | Murayama | 72/88 |
| 5,509,287 | 4/1996 | Garden | 72/88 |
| 5,661,994 | 9/1997 | Sundquist | 72/455 |

FOREIGN PATENT DOCUMENTS

| | | | |
|---|---|---|---|
| 549200 | 3/1977 | U.S.S.R. | 72/88 |

OTHER PUBLICATIONS

NACHI, Precision Roll Forming Machines, Forming Racks, brochure, 1996.

National Broach & Machine Co., Horizontal and Vertical Rack Rolling Machines, brochure, 1996.

National Broach & Machine Co., PFL and PFS Series, brochure, 1996.

*Primary Examiner*—Daniel C. Crane

*Attorney, Agent, or Firm*—Young & Basile, P.C.

[57] ABSTRACT

A vertical rack-type spline-forming machine based on a novel slide base arrangement comprising a pair of vertical slide bases structurally joined by a symmetrically arranged set of tie bars. The structurally-joined vertical slide bases can be rested in an upright position on a non-structural space frame which provides improved access and lift capabilities to the vertical machine. The machine also includes a novel drive system using independent electric motors, one motor associated with each vertical slide base to drive the rack on that base through a roller screw shaft mechanism. The racks are further electronically synchronized through position signals communicated between the motor drives, and the rack home positions are calibrated with electronic "datums" programmed into the motor drives and capable of being re-calibrated in programmable fashion if one of the racks loses synchronicity.

20 Claims, 12 Drawing Sheets

50e
50c
50
50c
50c
50f
52b
50c
50g
50b
50b
52
52a
50f
52c
50a
50a
50g
50a
50d
50d
51
50d
51

FIG-5
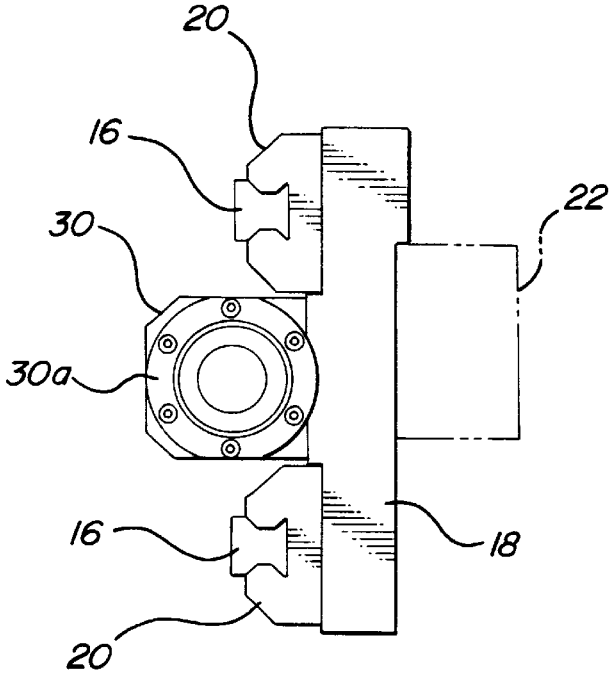
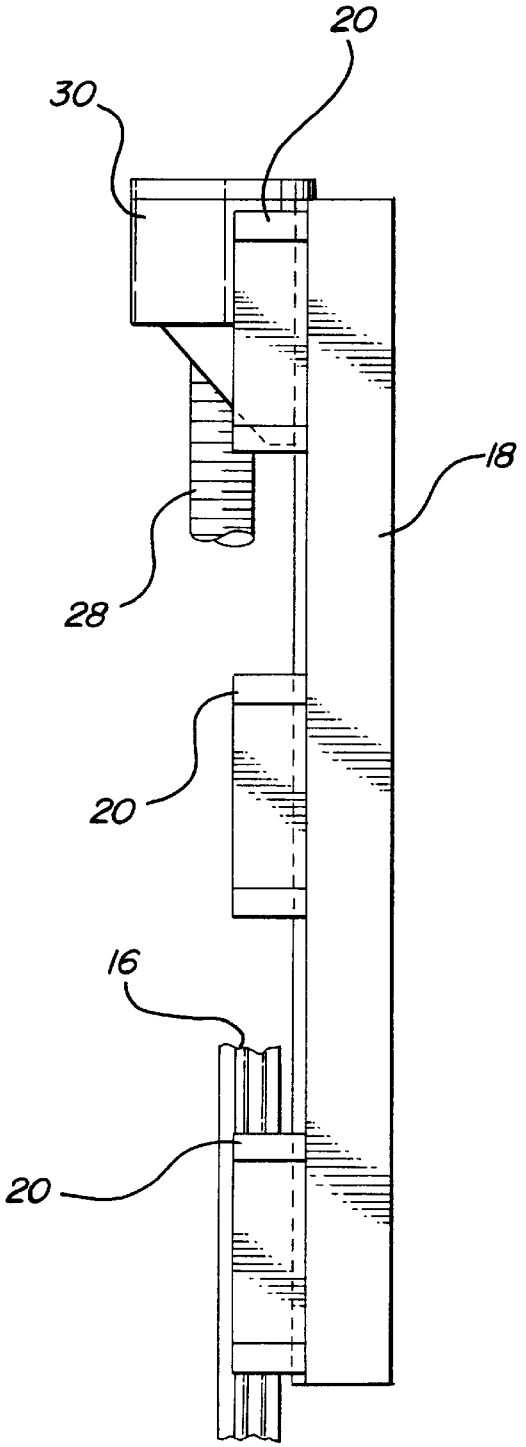
FIG-5A

VERTICAL RACK SPLINE FORMING MACHINE

FIELD OF THE INVENTION

This invention is in the field of spline-forming machines, and more particularly spline-forming machines which reciprocate forming tools such as toothed racks across a workpiece.

BACKGROUND OF THE INVENTION

Spline forming machines using reciprocating racks are well known in the art as evidenced, for example, by the large number of patents owned by the assignee of the present application. These include: U.S. Pat. No. 4,712,410; U.S. Pat. No. 4,712,408; U.S. Pat. No. 4,689,980; U.S. Pat. No. 4,677,836; U.S. Pat. No. 4,506,537; U.S. Pat. No. 4,487,047; U.S. Pat. No. 4,467,631; U.S. Pat. No. 4,399,678; U.S. Pat. No. 4,380,918; U.S. Pat. No. 4,270,375; U.S. Pat. No. 4,729,233; U.S. Pat. No. 4,741,191; U.S. Pat. No. 4,756,179; U.S. Pat. No. 4,756,182; U.S. Pat. No. 4,819,468; U.S. Pat. No. 4,829,800; U.S. Pat. No. 4,852,375; U.S. Pat. No. 4,882,926; U.S. Pat. No. 4,891,962; U.S. Pat. No. 4,956,986; and, U.S. Pat. No. 5,509,287.

Most spline forming machines currently used in the United States are of the horizontal type, in which horizontally reciprocating forming tools are driven across a rotatable workpiece to form the splines. However, the manufacturing industry is increasingly implementing the "cell" concept in which machines are grouped closely, requiring more efficient use of floor space than the typical horizontal spline-forming machine offers. In Japan, where the cell concept is more widely established, it is known to use vertical rack spline-forming machines of the type shown in U.S. Pat. No. 4,646,549 to Saito et al.

Vertical rack spline-forming machines, however, tend to be more lightly built and less rigid than horizontal machines, adversely affecting the spline-forming operation in which powerful forces are generated between the racks and the workpiece. Saito et al., for example, uses narrow "slide columns" as vertical bases, with a direct sliding fit between the slides and the column faces requiring massive slab-like front and rear tie bars through which workfeeding and slide-synchronizing mechanisms must be routed. The Saito et al. columns further require a structural lower base and upper connecting frame to tie the columns together. Friction between the mating slide and column faces is inherently high, and the tie bar preloading on the slide columns likely affects the fit of the slides on the column faces, the force of the spline-forming dies on the workpiece, and therefore the quality of the forming operation.

The hydraulic drive systems on prior machines, especially vertical machines such as Saito et al. where the drive cylinders are on top of the machine, present maintenance difficulties such as keeping the machine clean and free from hydraulic leaks. Known hydraulic drives also take up floor space, generate significant noise with their associated pressure packages, and require timers to shut pressure down during periods of non-use to conserve energy.

Another difficulty with vertical rack spline-forming machines is encountered when trying to locate their slide linkages and timing gear compactly around the machine. The common drive and linkage operating the two sliding racks must be synchronized, and Saito et al. discloses several fairly complicated arrangements for doing so: timing racks connected to the spline-forming "flat dies", the timing racks meshing with a passive synchronizer or timing gear; a hydraulically-driven timing gear; motor-driven crank arms and connecting rods; and a hydraulic circuit activated by limit switch position sensors.

Another drawback of prior art machines is the need for a datum surface against which the reciprocating racks are calibrated during assembly so that each rack is evenly positioned relative to the workpiece. If either of the spline-forming racks loses its calibration and therefore its synchronicity with the other rack, it is often necessary to either regrind the datum surfaces, or to make a full-tooth adjustment to the out-of-sync rack.

SUMMARY OF THE INVENTION

It will be understood by those skilled in the art that the term "spline-forming machine" as used herein refers to a known class of machines which may go by other names and whose use may vary somewhat depending on the exact nature of the workpiece and type of forming operation. For example, the Saito et al. patent refers to such machines as "apparatus for rolling a cylindrical blank". The term "spline-forming machine" as used in this application refers to such a class of machines.

It should also be understood that the term "rack" as used herein generally refers to that class of forming tools used in spline-forming machines. Saito et al., for example, refers to the forming tools as "flat dies".

In a first aspect, the invention is an improved vertical rack spline-forming machine built around a pair of vertical slide bases structurally connected by a novel tie bar arrangement. The structural forces generated by the forming operation are balanced and contained by the slide bases and tie bars alone, without the need for additional structural connections such as the connecting upper frame and lower base shown in the Saito et al. patent. In the illustrated embodiment, two vertical slide bases are tied together with upper and lower pairs of tie bars symmetrically arranged around the workpiece, allowing the bases to "parallel breathe" such that the forces exerted on the workpiece remain centered throughout the work cycle. The tie-bar connected bases, which form a structural unit of great integrity on their own, can be mounted upright in a simple space frame, with work-generated forces contained between the tie bars and not borne by the space frame.

Each of the vertical slide bases mounts a reciprocating slide with a forming tool of conventional type. However, each of the slides is mounted for travel on its respective slide base by a novel carriage and rail structure in which each slide is connected to a set of spaced rails on the slide base by one or more carriages.

The drive system for the vertically reciprocating slides presents another inventive aspect of the new machine. Broadly speaking, the drive system for each slide is an independent electric motor spinning a roller screw shaft connected to the rail-mounted slide. The roller screw is connected to the slide to rapidly and precisely drive the slide up and down along the slide base. In one preferred embodiment, the position and speed of the slide are controlled by monitoring apparatus associated with the motor to keep track of slide position as a function of shaft angle and the total number of shaft rotations. A tooth clutch type brake can be used on the shaft to hold the slide as a safety feature once the servomotor has stopped the slide at a predetermined limit. The illustrated system as a whole has been found capable of controlling the position of each slide within one ten-thousandth of an inch (0.0001 inches).

Calibration and synchronization of the slides is critical. In the prior art, calibration is achieved with precision ground datum surfaces at the ends of each slide, and synchronization is achieved with complex linkages and timing gears. In yet another aspect of the present invention, calibration and synchronization are achieved in novel fashion by replacing physical datum surfaces with electronic "datum surfaces" programmed into the motor control circuitry, for example a PLC built into or communicating with the motors and their shaft angle encoder systems. The independently driven slides are calibrated and then driven synchronously by electronic signal, rather than with the physical reference point and mechanical drive linkage characteristic of the prior art. The term "electronic" is used broadly here, and encompasses digital, analog, optical and other similar electrical-based, nonmechanical data storage and signal communication devices and techniques.

Other aspects of the present invention include a bolt-together machine design; improved front and rear access to the machine and its control and workpiece-feeding accessories, eliminating unnecessary side access so that machines can be stacked side by side; and improved access to and through an electrical panel uniquely mounted on a portion of the machine's space frame.

These and other advantages and inventive features of the new machine will become apparent upon further reading, with reference to the drawings.

BRIEF DESCRIPTION OF THE DRAWINGS

FIG. 5 is a plan view of a single slide;

FIG. 5A is a side view of the slides in FIG. 5;

DETAILED DESCRIPTION OF THE ILLUSTRATED EMBODIMENT

Figure 1:
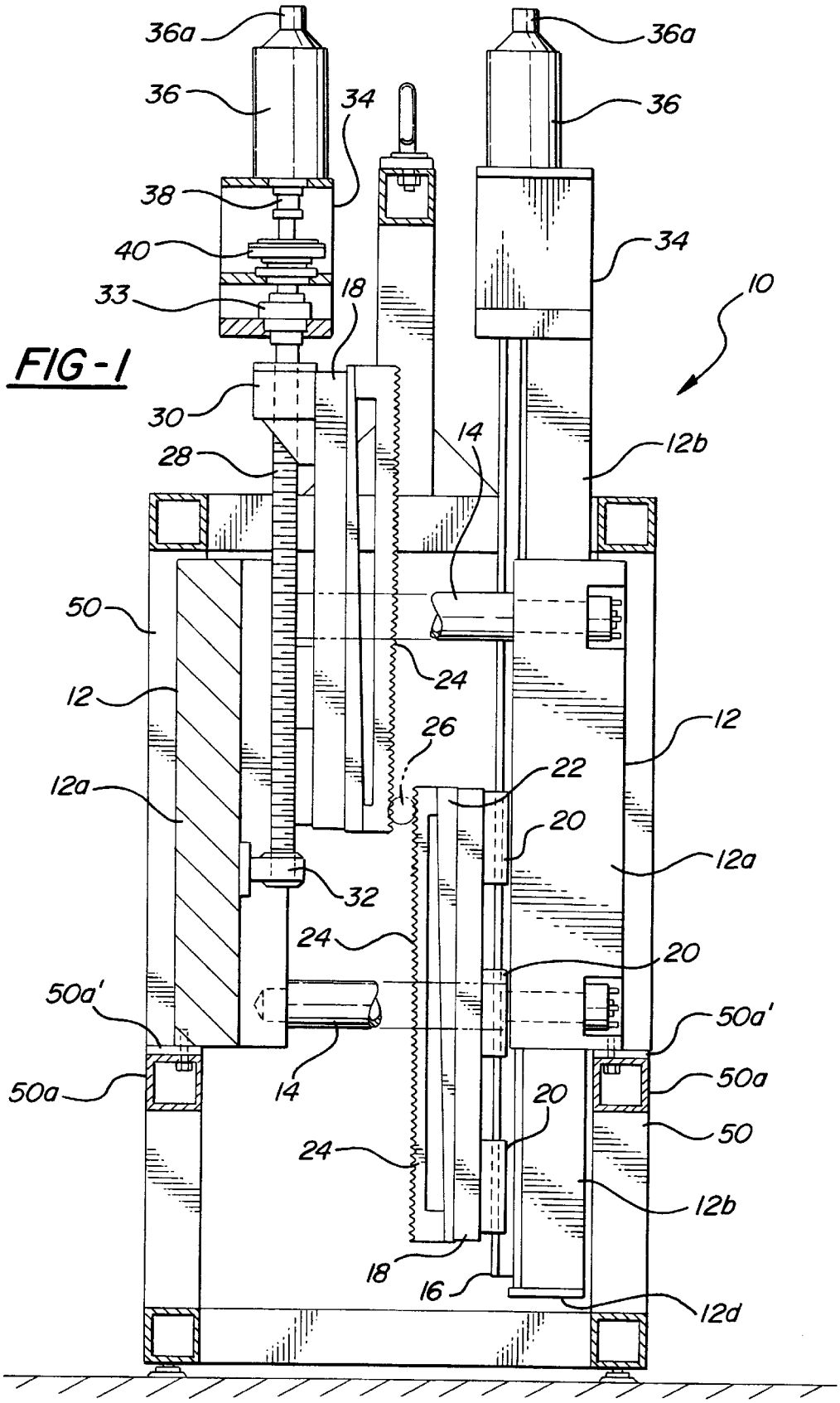
FIG. 1 is an elevational view, partially in section, of the front (workpieceloading) face of a vertical rack spline-forming machine according to the present invention.
Figure 1A:
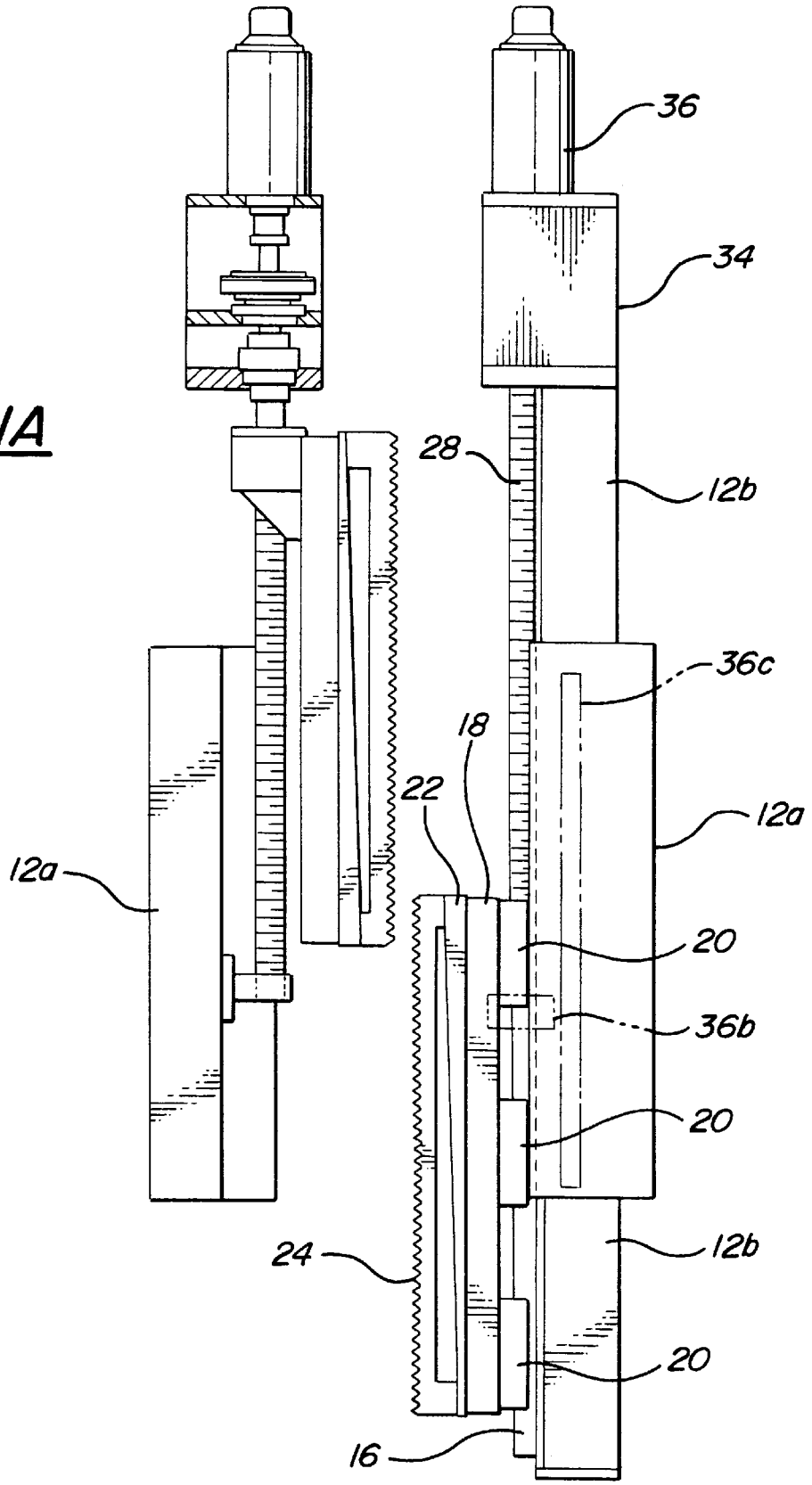
FIG. 1A is a simplified elevational view of the machine shown in FIG. 1.
Figure 2:
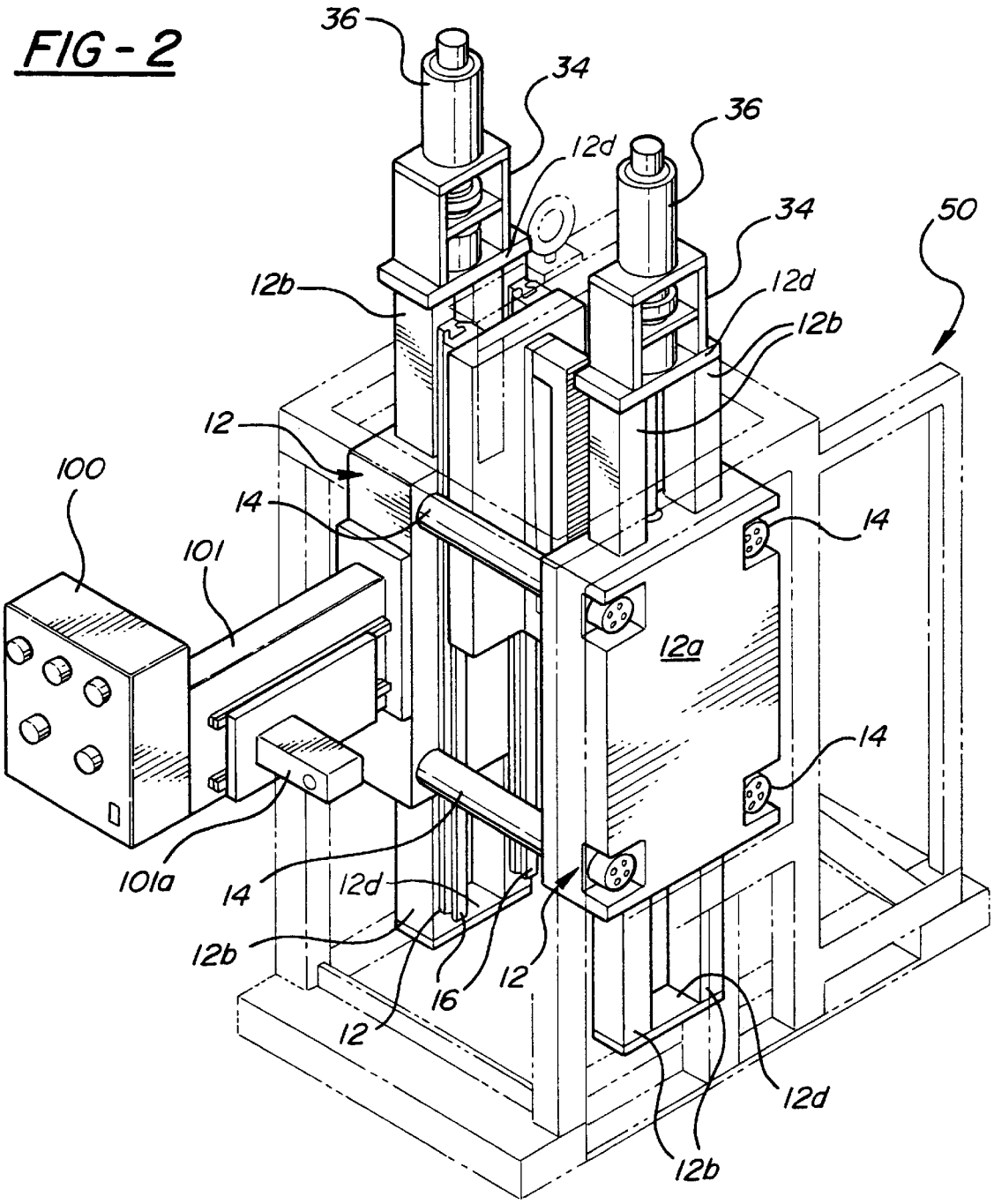
FIG. 2 is a perspective view of the machine of FIG. 1, from the front left side, additionally illustrating a workpiece holding/loading station of conventional type on the front of the machine, and a novel space frame around the machine in phantom lines.

Referring first to FIGS. 1, 1A and 2, a vertical rack spline-forming machine according to the present invention is illustrated to clearly show its fundamental components: vertical slide bases and tie bar connecting structure; slide and rack fixture assemblies; motor operated roller screw drive system; and non-structural space frame.

The Vertical Slide Bases And Tie Bar Connecting Structure

The structural heart of the new machine is a pair of vertical slide bases 12 joined together by upper and lower sets of parallel tie bars 14. Slide bases 12 are each formed from cast and/or machined metal such as steel. The size of the slide bases in the illustrated example is on the order of eight to ten feet high. Slide bases 12 include two distinct portions: thick, blocklike structural "plates" 12*a* in the center, and slide rail supports 12*b* extending up and down from the top and bottom edges of plates 12*a*. As best shown in FIG. 2, rail supports 12*b* preferably take the form of two spaced parallel beams extending from the upper and lower ends of plates 12*a*. In the illustrated embodiment, rail supports 12*b* are separately formed and then attached by welding or bolting to plates 12*a*. Supports 12*b* can also be integrally cast with plates 12*a*.

While spaced parallel supports 12*b* are preferred, a single wide support could also be used to support the below-described slide rails if weight and cost are not factors. However, spaced supports 12*b* provide ready-made clearance and access for drive mechanisms discussed below.

Figure 4:
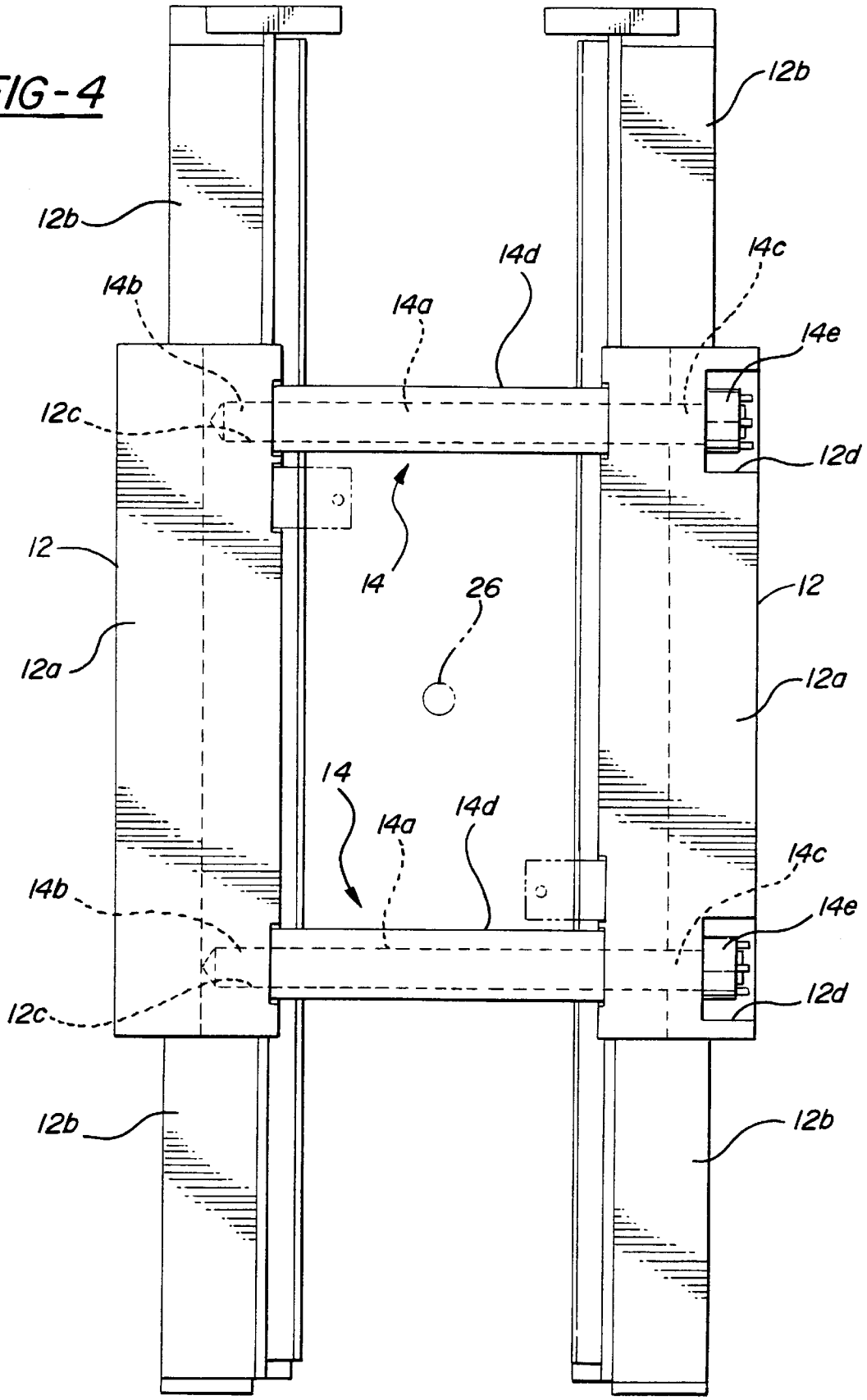
FIG. 4 is a simplified front elevational view of the machine in FIG. 1, illustrating the tie bar connecting arrangement for the vertical slide bases.

Referring to FIGS. 1, 2, and 4, vertical slide bases 12 are structurally joined with tie bars 14. Illustrated tie bars 14 comprise an elongated center stud 14*a* with threaded screw and nut ends 14*b* and 14*c*, a spacer sleeve 14*d*, and a pre-loading nut tensioner 14*e*. Threaded screw end 14*b* of each tie bar is secured in one of four threaded blind bores 12*c* formed in lefthand side plate 12*a*, while threaded nut end 14*c* and pre-loading nut 14*e* are located in wells 12*d* formed in the outside face of righthand side plate 12*a*. The tie bars may optionally include fitting spacers (not shown) between sleeves 14*d* and side plates 12*a*, as needed, to properly space and tension the two slide bases for different forming operation.

It will be understood by those skilled in the art that only one possible type of tie bar is illustrated by way of preferred example, and that the type of tie bar used to join the slide bases can vary.

Pre-loading type nuts 14*e* are preferred, are commercially available, and can be used not only to produce high pre-stress levels to maintain tie bar tension through thousands of work cycles, but further enable the user to fine-tune the tension of each tie bar 14 so that tension forces on the structurally joined slide bases 12 are even. Alternately, a standard nut can be used to tension the tie bars.

The symmetrical spacing of the high strength, evenly tensioned tie bars orthogonally bracketing the workpiece 26 at the center of the machine (at right angles to the longitudinal workpiece axis) allows the machine to "parallel breathe" as the force generated by the racks on the workpiece increases during a work cycle. Workgenerated forces thus remain centered on the workpiece, resulting in more precise control over the critical dimensions of the splines formed on the workpiece.

Once slide bases 12 have been joined by the above-described tie bar arrangement, they are a structural unit with no further need for framing or connecting other than a stand to hold the machine upright in a vertical position. In the illustrated embodiment, this is achieved with a space frame 50 formed from steel box tubing welded or bolted together. The lower ends of slide base plates 12*a* rest on horizontal bars 50*a* and are secured thereto, preferably by bolting. While space frame 50 provides a stabilizing support to hold machine 10 in an upright position, it does not need to provide structural rigidity, which is achieved with tie bars 14 acting through plates 12*a*.

The Rack Slides and Rail Structure

Each slide base 12 carries a vertically reciprocating slide and rack fixture assembly on a spaced pair of rails 16, which are fastened to plates 12*a* and rail supports 12*b*, preferably by bolting. In the illustrated embodiment, multiple pairs of slide carriages 20 on rails 16 carry a slide 18, a fixture 22, and a forming tool such as rack 24. In the illustrated embodiment, fixtures 22 and racks 24 are of known type, for example manufactured by Anderson Cook, Inc. of Fraser, Mich. and incorporated in their commercially available horizontal spline-forming machines.

Figure 4A:
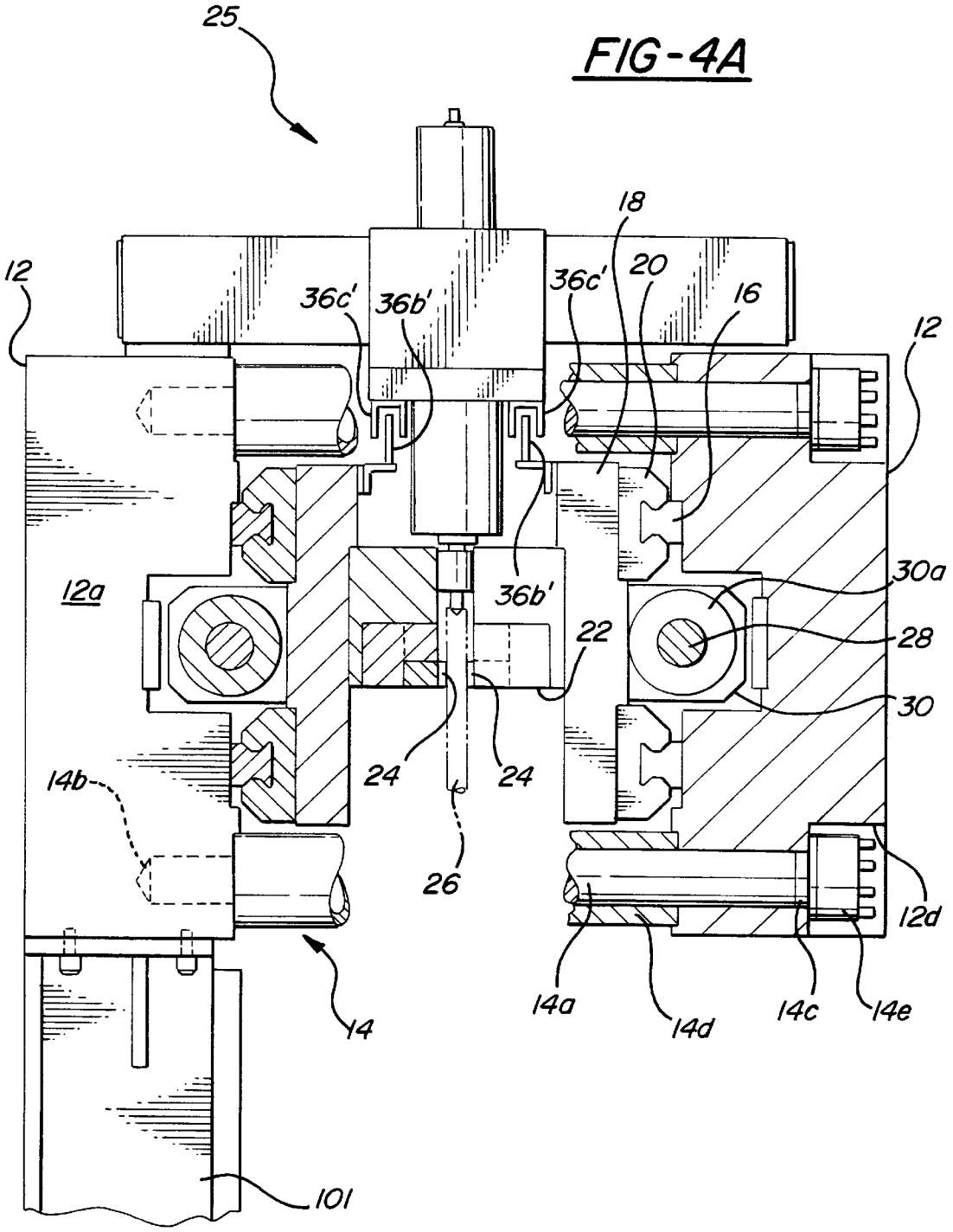
FIG. 4A is a plan view, partially in section, of the machine of FIG. 1, illustrating details of the slide bases and slides, in particular the reciprocating rail-mounted carriage structure.

The slide, carriage and rail structure of the present invention is best shown in FIG. 4A, in which rails 16 and carriages 20 are illustrated in plan view. Rails 16 and carriages 20 can be of a commercially available type, for example the Roller Rail® system made by Mannesmann Rexroth. While the illustrated embodiment shows multiple sets of carriages 20 for each slide 18, the number may vary depending on the length of the slide and the spline-forming rack 24 carried on the slide by fixture 22.

FIG. 4A also illustrates a roller nut assembly 30 attached to the lower surface of each slide 18 between rails 16 and carriages 20 (see FIG. 1). In the illustrated embodiment, roller nut assembly 30 is a bracket housing a roller nut 30*a* connected to a roller screw drive shaft 28.

FIG. 4A also shows a conventional headstock assembly 25 fastened to the rear of slide bases 12, the headstock assembly capable of receiving and rotatably mounting the workpiece 26 along a longitudinal centerline axis between the splineforming racks 24. The workpiece is fed longitudinally into the center of the machine and onto the headstock spindle by a conventional outboard support device 101 whose details are not part of the present invention.

Slide assemblies 18, 20, 22, 24 are vertically reciprocated on their respective slide bases, one going up while the other goes down across workpiece 26, which is rotatably held at the centerline of the machine in known fashion. The spline-forming teeth or ridges of racks 24 are set at a wedge-like angle by fixtures 22, progressively increasing their force on workpiece 26 to form the splines. In the illustrated example, the travel of each rack is on the order of thirty-six inches, which is within an average range for the industry, but which will vary depending on the size of the workpiece and the depth of the splines being formed.

The Electric Motor Drive System

To drive the slide assemblies up and down on their respective bases, the machine of the present invention is provided with a novel drive system comprising an electric motor and roller screw drive on each slide base 12. By providing each slide assembly with its own motor drive, and further by using a preferred direct drive type servomotor, the racks can be driven with greater precision and synchronized with greater ease than in prior art systems using mechanically or hydraulically linked racks with a common hydraulic drive. The electric motor drive of the present invention allows each rack to be electronically calibrated and synchronized, without the need for physical datum surfaces which must be periodically reground. The electric motor drive also eliminates the noise, pressure package, and maintenance problems associated with prior art hydraulic drives, preserves floor space otherwise taken up by hydraulic drives, and is relatively lightweight and simple, important considerations for a vertical machine where the drive is located at the top of the machine and may only be accessible by ladder.

Figure 6:
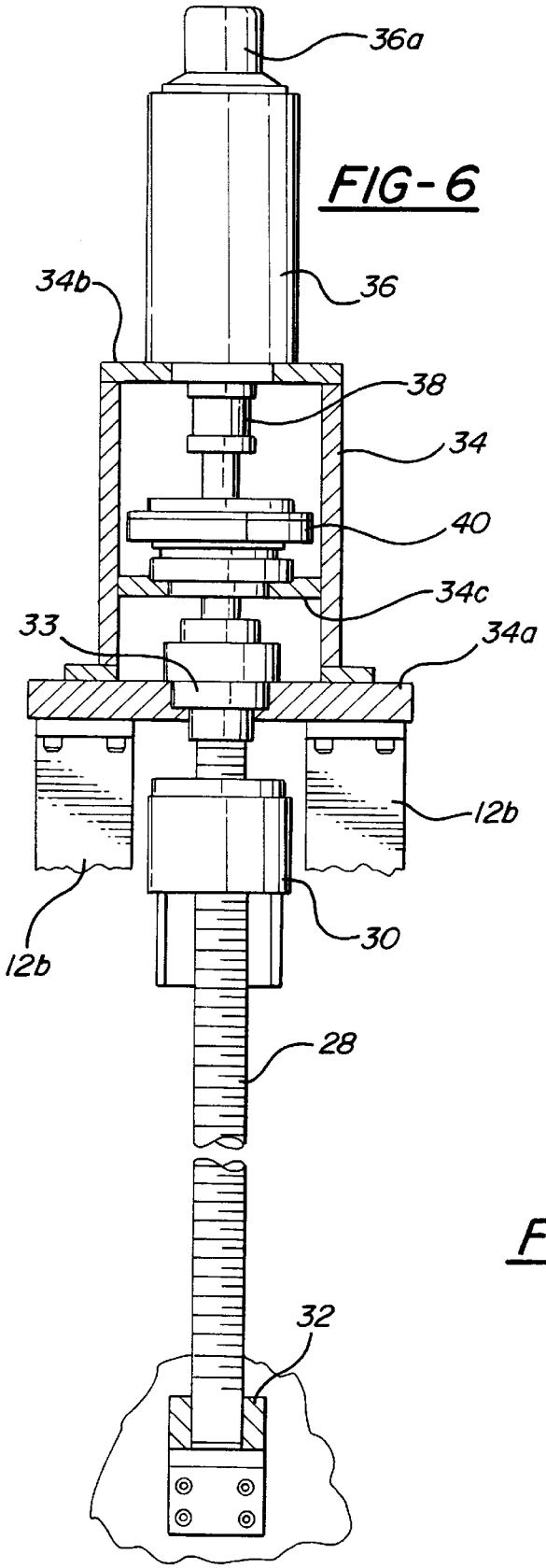
FIG. 6 is a shortened, partially sectioned front elevational view of a motor and roller screw drive system according to the invention, used for driving a slide up and down on its slide base.

In the illustrated embodiment, with emphasis now on FIGS. 1 and 6, a roller screw shaft 28 is connected by roller nut assembly 30 to the upper end of slide 18 between rails 16. Roller screw shaft 28 is fastened to slide base 12 by a floating bearing assembly 32 at its lower end, and by a fixed bearing 33 in drive housing 34 on the upper end of base 12. Roller screw shaft 28 is intermittently rotated at high speed by a direct drive electric servomotor 36 whose output is coupled to roller screw shaft 28 through a torsion-resistant flexible coupling 38 and tooth clutch type brake 40 in housing 34.

In the illustrated embodiment, roller screw shaft 28 and nut 30, servomotor 36, coupling 38, and tooth clutch brake 40 are commercially available items. For example, suitable planetary roller screws and roller nuts are available from INA of Germany; servomotors 36 can be purchased commercially from the Indramat Division of the Rexroth Corporation of Wood Dale, Ill.; couplings 38 are available from Gam Enterprises Inc. of Chicago, Ill.; and tooth clutch brake 40 can be of the type available from Horton Industrial Products, Inc.

Figure 6A:
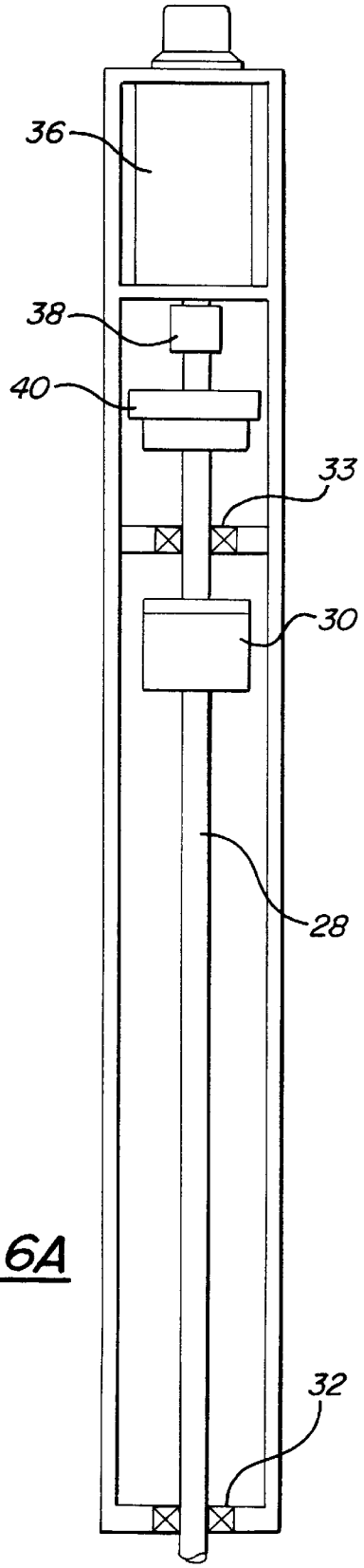
FIG. 6A is a simplified, schematic illustration of a preferred drive system according to the invention.

Referring to FIGS. 6 and 6*a*, it will be apparent to those skilled in the art that the specific example of a motor drive system as shown in FIG. 6 is a preferred example which is not intended to limit the invention to the specifically-named components above. While many of the components can be purchased commercially, those listed above are not exclusive. The schematic illustration of the drive system in FIG. 6*a* better illustrates the fact that it is the broad concept of a motor drive operating a roller screw shaft which is believed to be inventive. And while the disclosed arrangement of couplings, bearings and braking mechanisms is preferred, the invention is believed to reside more broadly in the motor drive and shaft arrangement.

The Space Frame

Figure 2A:
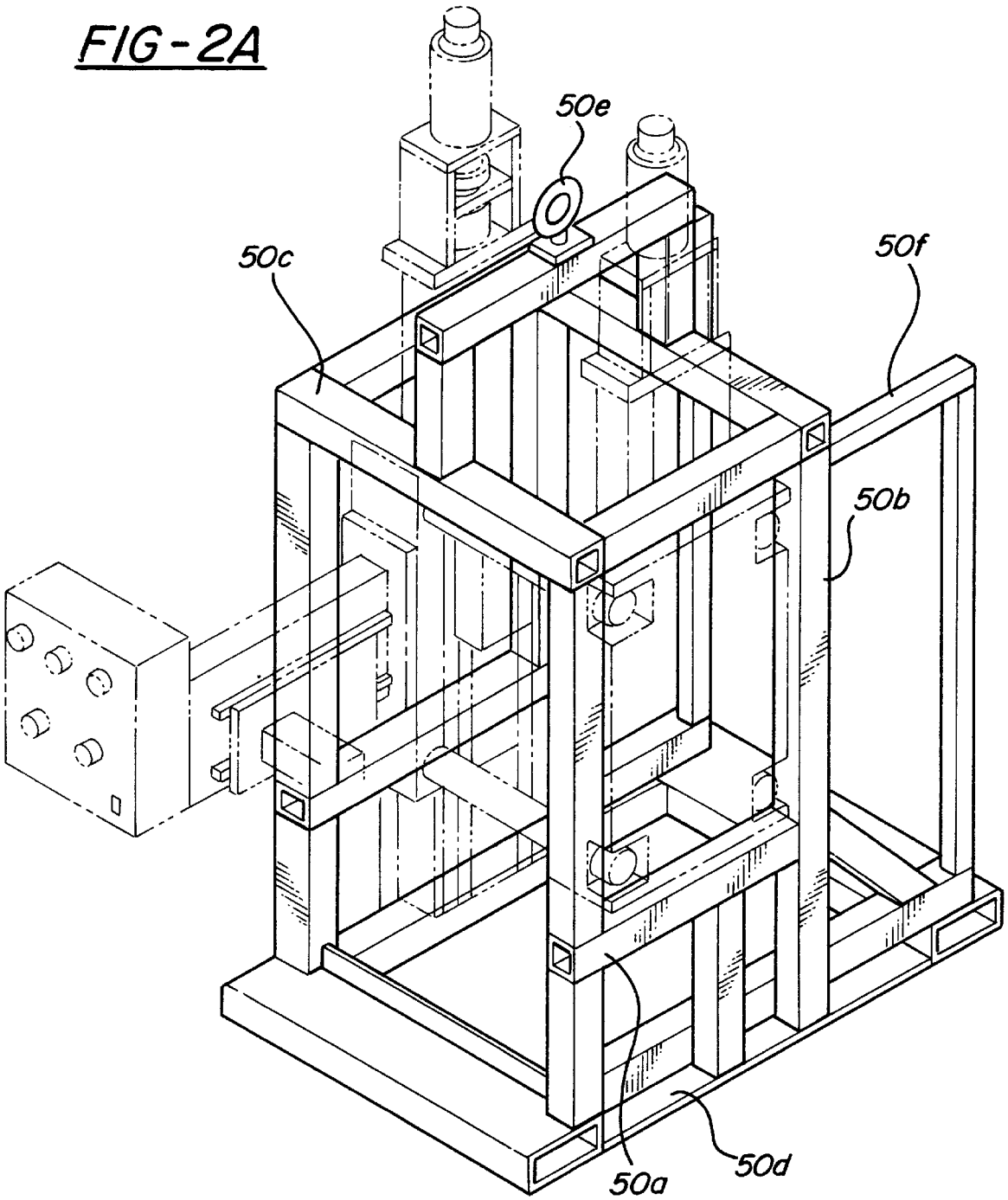
FIG. 2A is the same view of the machine as in FIG. 2, except that the machine is shown in phantom lines, and the space frame is shown in solid lines.
Figure 3:
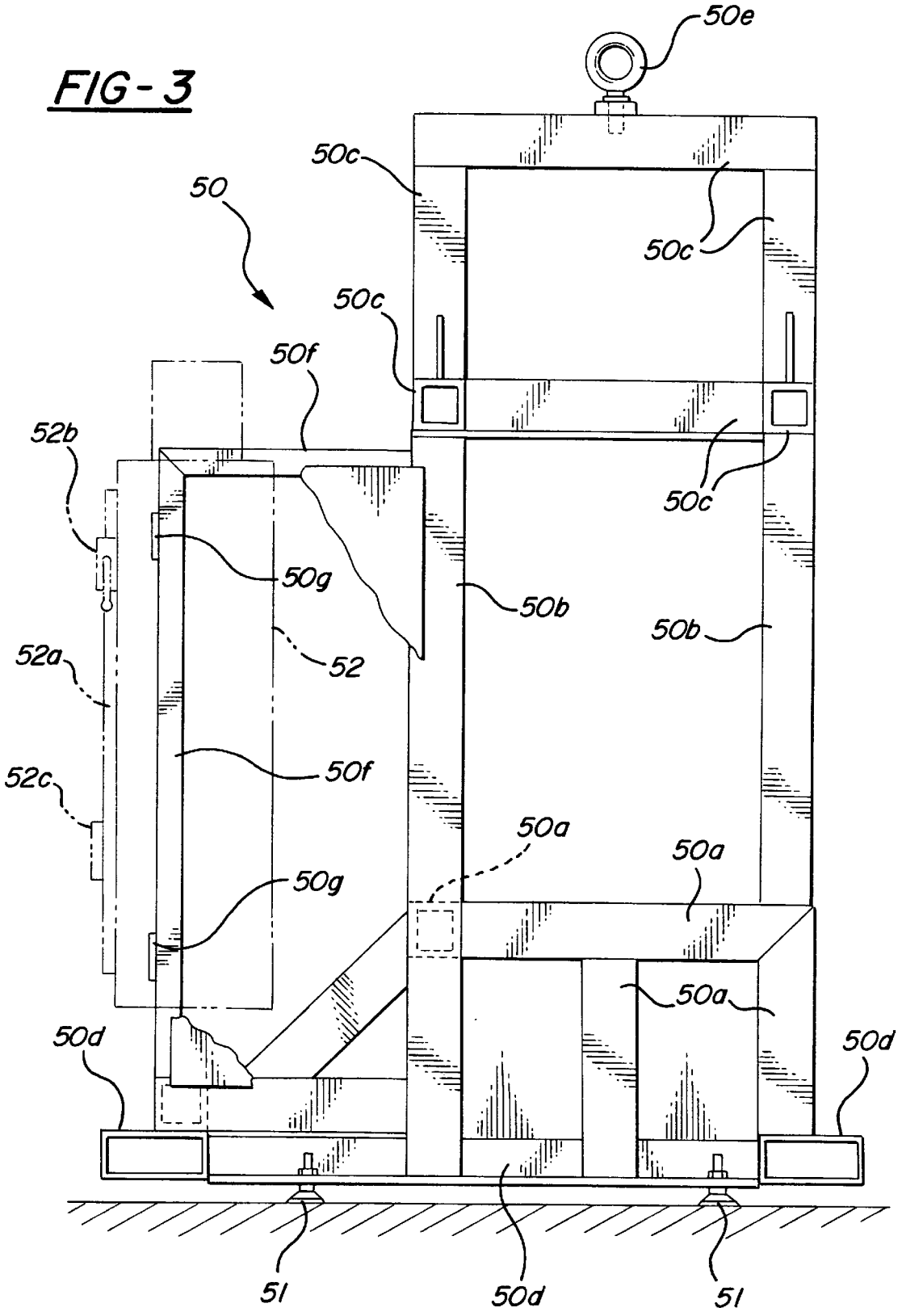
FIG. 3 is a right side elevational view of the space frame of FIG. 2, with a hinged electrical panel illustrated at the rear of the frame in phantom lines.

Referring to FIGS. 2, 2A and 3, details of the space frame 50 are shown in relation to the vertical machine. Space frame 50 is itself novel in that it is designed to provide an upright support for the above-described vertical rack spline-forming machine. Space frame 50 also accommodates the previously mentioned "cell" concept in which it is desirable to group several machines closely together side-by-side.

Illustrated space frame 50 is preferably formed from hollow steel tubing in a rectangular or square cross-section ("box tubing"), but may be formed from other known framing members of suitable strength and with different cross-sections, thicknesses and degrees of hollowness in the tubing. Space frame 50 generally consists of a box-like lower main frame 50*a*, uprights 50*b*, a box-like upper main frame 50*c*, floor members 50*d* with feet 51, and a lift attachment such as an eyebolt 50*e*. Illustrated frame 50 in FIGS. 3 and 3A also preferably includes a rear access frame 50*f* on which an electrical panel 52 is mounted like a door to swing open for access to the rear of the machine.

Frame 50 functions as an upright stand for the vertical rack spline-forming machine 10, which primarily rests on lower main frame 50*a*, in particular on the right and left horizontal supports as best shown in FIG. 1. Slide base plates 12*a* are wide enough on their lower surfaces to rest on lower frame 50a, and can be secured to lower frame 50*a* by bolting, for example. In the illustrated embodiment, the upper surfaces of horizontal supports 50*a* include reinforcement flanges or brackets 50*a*' welded to 50*a*. Slide bases 12*a* are then bolted to frame 50 through supports 50*a* and flanges 50*a*' to secure machine 10 against vibration.

In the illustrated embodiment, slide bases 12 further include brackets 12*d* bridging the lower ends of rail supports 12*b* for adding stability to supports 12*b*, which are free-hanging in the sense that their ends are not attached to frame 50. It is also desirable to connect the upper end of machine 10 to frame 50, for example by bolting the upper surfaces of side plates 12*a* to upper main frame 50*c*. Like their lower end counterparts, the ends of upper rail supports 12*b* are preferably bridged by a stabilizing bracket 12*d* and are free-standing. It is preferred that frame 50 be sufficiently strong to act as a lift support for machine 10, allowing a crane or hoist to be attached to upper main frame 50*c*, for example to eyebolt 50*e*, to carry frame 50 and/or machine 10 to a different location. For this purpose the frame members are preferably joined by welding, with the exception of front uprights 50*b* which are detachable (e.g. bolted to frame 50) to insert and remove machine 10 into and from the frame.

Electrical Panel Mounting

Figure 3A:
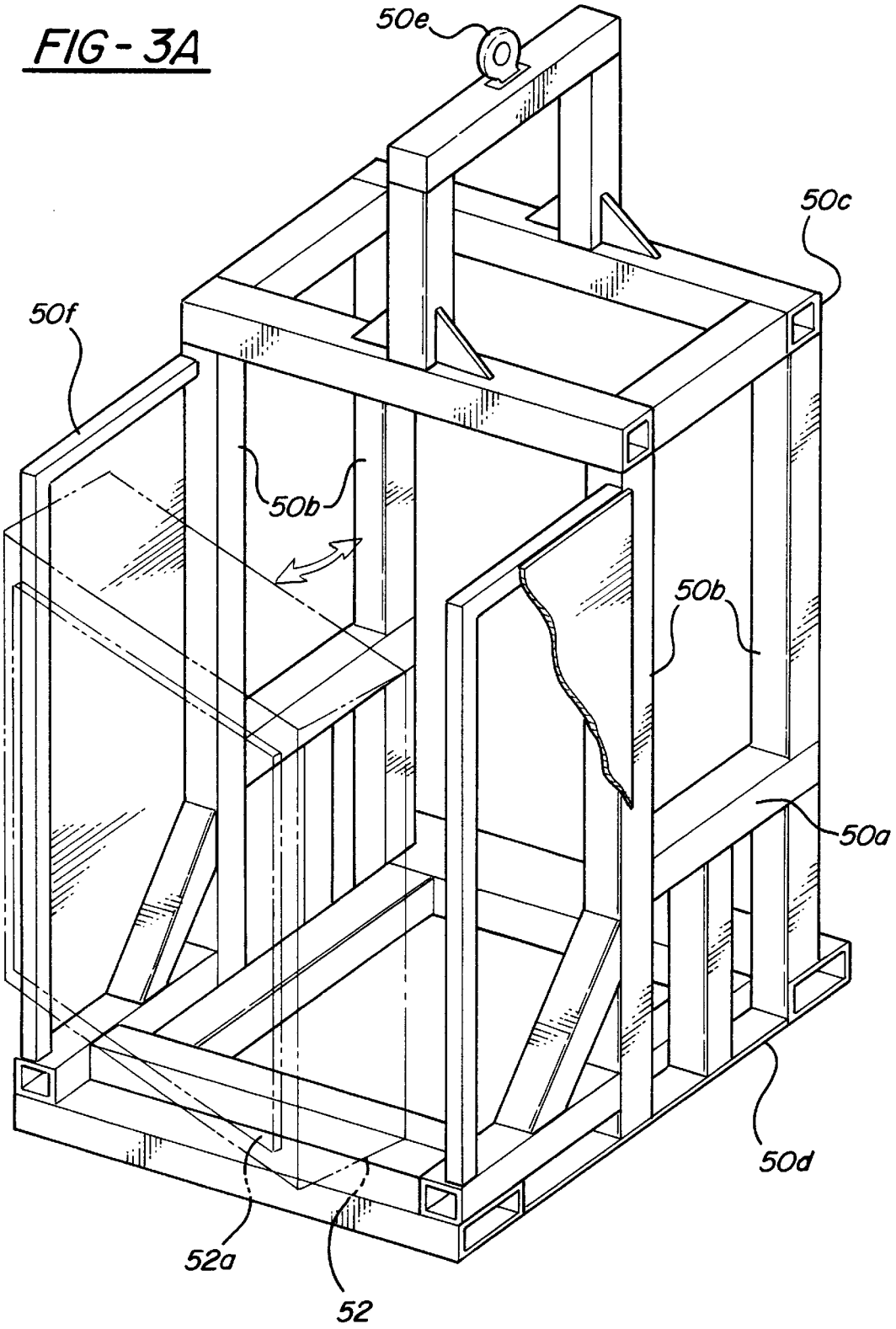
FIG. 3A is a rear perspective view of the frame and control panel shown in FIG. 3.

Referring now to FIGS. 3 and 3A, the rear access portion 50*f* of illustrated frame 50 provides a novel and convenient support structure for electrical panel 52 which houses, for example, power bus terminals and power/control modules for the drive motors, and a programmable logic controller (PLC) with input/output communicating with the motor modules, with the operator workstation at the front of the machine, and with secondary machine components such as the workpiece-feeding outboard support and limit switches. Electrical panel 52 is preferably mounted so that it can be swung open on hinges 50*g* to provide unobstructed, doorway-type access to the rear half of machine 10 through frame 50. Access to the interior of electrical panel 52 is by way of latches and handles 52*b* and 52*c* used to open and close door 52*a* on the electrical panel.

It will be appreciated by those skilled in the art that space frame 50 lends itself to being paneled over to present a pleasing appearance, to prevent unauthorized access to the interior of the machine (except through the hinged electrical panel 52, which may be locked to rear frame 50*f* to limit access from the rear of the machine), and to reduce noise.

Communication And Control System

Figure 7:
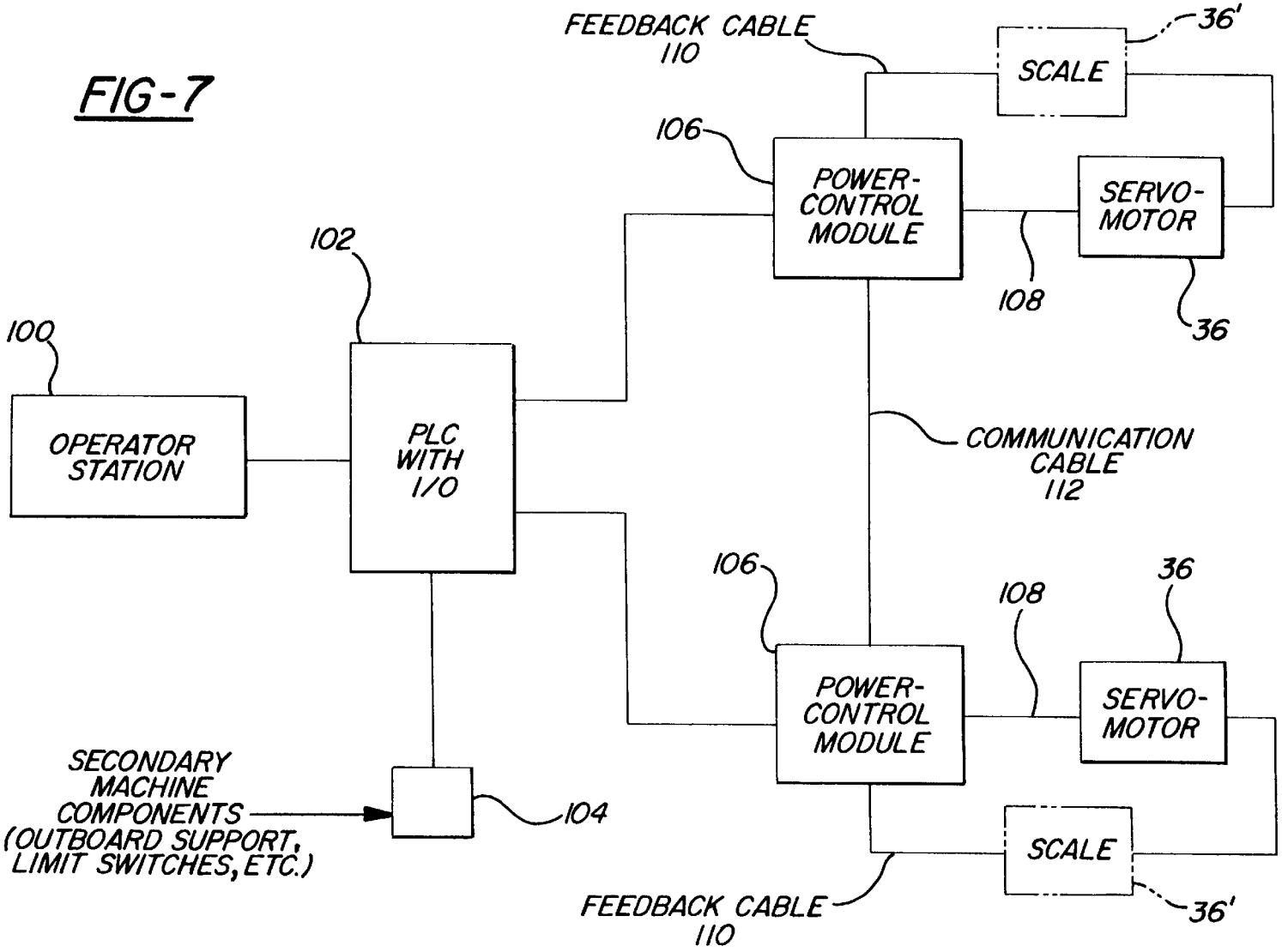
FIG. 7 is a schematic representation of the electronic control and communication system used to control the machine illustrated in FIGS. 1–6, in particular the electronic control of the motors driving the slides.

Referring next to FIG. 7, a preferred communication and control system is illustrated schematically for machine 10. While it will be apparent to those skilled in the art that the exemplary control and communication system for machine 10 disclosed in the present application can be configured with some flexibility, depending on operator requirements, FIG. 7 illustrates a basic control layout especially suited for the dual servomotor drive system described above.

Operator station 100 is of a generally known type, for example comprising an operator terminal and configurable operator panel including display screens, key pads and buttons for entering information and commands, and other functions known to those skilled in the art. In the illustrated embodiment, however, the operator station includes a PLC-type operator terminal and configurable operator panel which can be used to monitor and operate the above-described servomotors 36. Suitable PLC-type operator terminals and configurable operator panels are commercially available, for example from Indramat. Operator station 100 is located in the front of the machine as best shown in FIG. 2.

Operator station 100 communicates by cable with PLC 102, which may be located in the operator station or remotely in the electrical panel 52 at the rear of the machine. In the illustrated embodiment, PLC 102 is a commercially available item, for example part of a CNC-type control system module from Indramat.

PLC 102 provides output signals to secondary mechanic components collectively shown at 104, and to power control modules 106, each of which independently communicates with one of servomotors 36 operating the roller screw drive described above. Upon command from operator station 100, PLC 102 provides output to modules 106, which signal servomotors 36 via motor cables 108. Feedback cables 110 return information such as motor speed, shaft angle, and shaft rotation from the shaft angle encoder built into the servomotor. Alternately or additionally, a linear scale type device 36', for example as schematically illustrated at 36*b*, 36*c* and 36*b*', 36*c*' in the drawings, may be used to supply slide position information to modules 106. Power control modules 106 enable the servomotors to "talk" with one another by electronic signal for calibration and synchronization purposes, in the illustrated embodiment via communication cable 112. It may also be possible to provide cable-free communication between the motors, for example by radio, optical, or similar wireless communication techniques known in the art. The means of communication between the two servomotors will depend on the type or make of motor selected for use in the machine.

Figure 8:
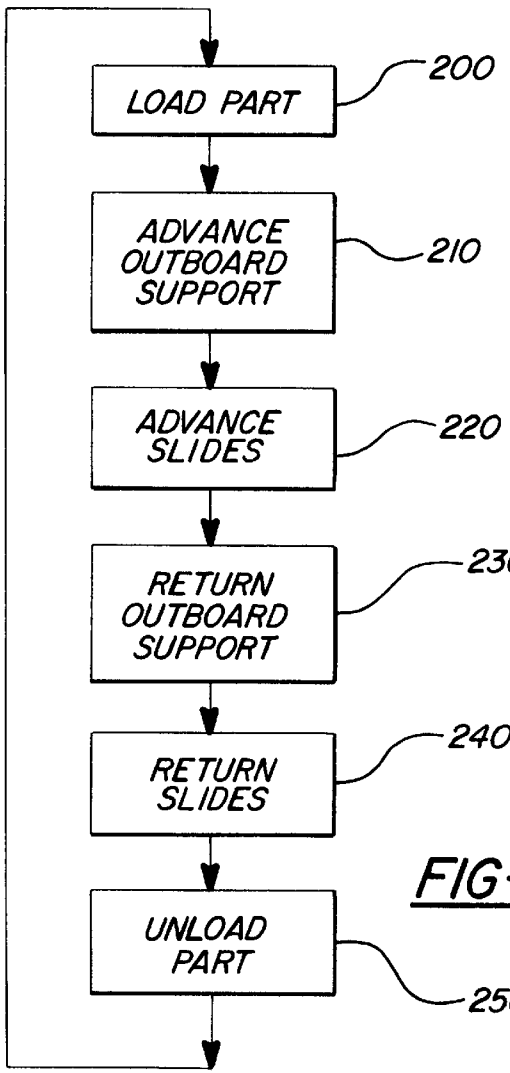
FIG. 8 is a schematic flow chart representation of a machine cycle for loading, operating, and unloading the machine of FIGS. 1–7; and, FIG. 9 is a schematic illustration of the electronic calibration and synchronization of the slides.

Referring now to FIG. 8, a machine cycle for loading a workpiece into machine 10, forming splines on the workpiece, and unloading the workpiece from the machine is illustrated schematically in flowchart form for a preferred cycle of operation.

At step 200 the workpiece, typically an unformed cylindrical shaft, is manually or automatically loaded into a workholding bracket 101*a* (FIG. 2) in the outboard support at the front of the machine in known manner.

At step 210 the outboard support is advanced, moving the loaded part into the machine for the forming operation. PLC 102 illustrated in FIG. 7 receives the "advance outboard support" command from the operator station, and uses an I/O signal to advance the outboard support as a secondary machine component 104.

At step 220, the rack slides are advanced from their "home" position and reciprocated across the loaded workpiece, in the illustrated embodiment forming spline teeth around the portion being formed. PLC 102 receives the "advance slides" command from the operator station. The PLC then provides output to the two servomotor power/control modules, which signal the two servomotors to advance the slide. Motor speed and shaft angle encoder information received through the servomotor feedback cables and shared over the communication cable between the two power/control modules ensures slide synchronicity.

At step 230, the outboard support is returned to remove the formed part from the machine. The PLC receives the "return outboard support" command from the operator station, and the PLC uses I/O signals to return the outboard support.

At step 240, the slides are returned to their "home" position. The PLC receives the "return slides" command from the operator station, and provides output to the two servomotor power/control modules which then signal the two servomotors to return the slides.

At step 250, the part is unloaded from the machine workholding bracket. This completes the end of one forming cycle, which can then be repeated on subsequent workpieces.

Figure 9:
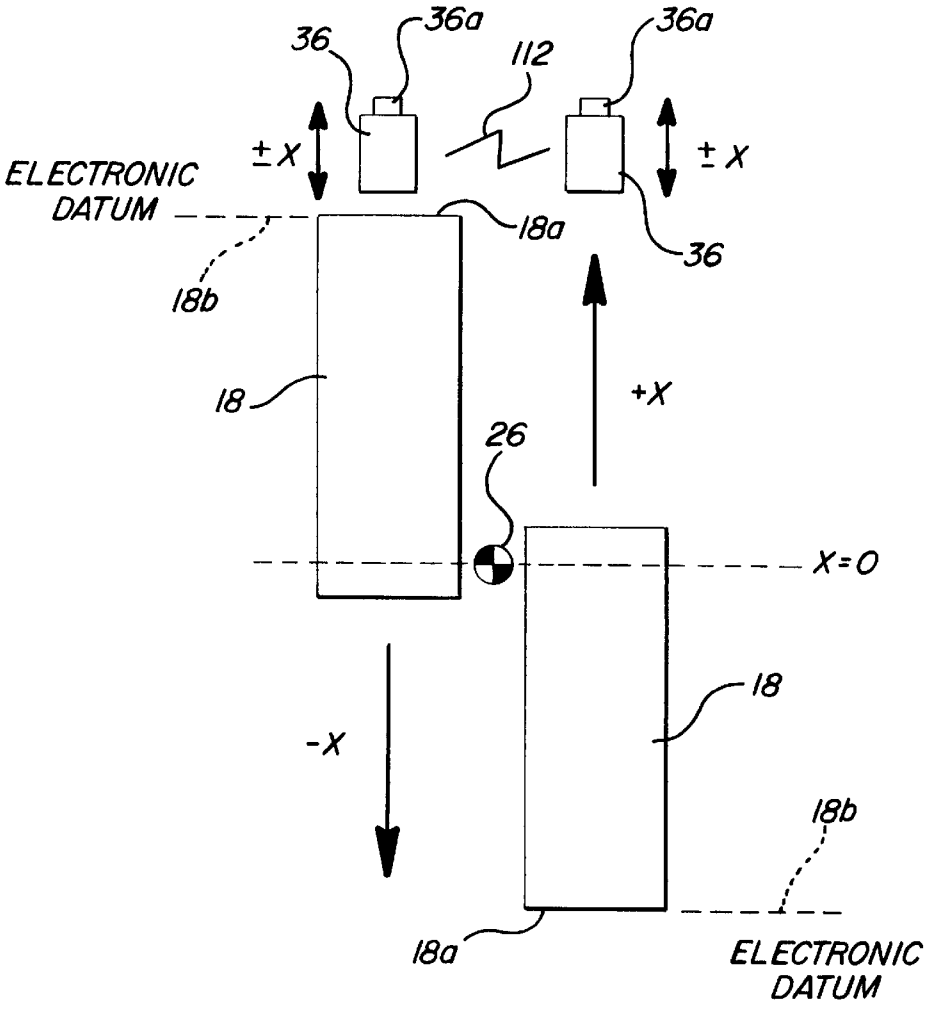

Referring now to FIG. 9, the electronic calibration and synchronization of the rack slides is illustrated with a diagram representing rack slide travel from a home position relative to a workpiece centered at reference point x=0. In FIG. 9, the longitudinal axis of loaded workpiece 26 is at height x=0 looking face-on into machine 10. In their home positions, home ends 18*a* of schematically illustrated slides 18 rest at electronic datums 18*b* ($-x_{max}$ and $+x_{max}$ in the reference scheme of FIG. 9). In some instances it may be desirable, although not necessary, to back up the electronic datums 18*b* with actual physical datums (not shown) of known type.

While the illustrated example shows home ends 18*a* of slides 18 being calibrated to their home position, it will be understood by those skilled in the art that the electronic data can be associated with different portions of the slides, fixtures or racks at different vertical locations since it is not limited to a physical surface as in the prior art.

Electronic datums 18*b* are established by programming in PLC 102 (FIG. 7). Shaft angle encoders 36*a* built into servomotors 36 provide realtime measurement of the exact position of slides 18. Power/control modules 106 (FIG. 7) and PLC 102 monitor the positions of slides 18 with respect to electronic datums 18*a* and to each other. Communication 112 between servomotors 36, shown in FIG. 7 between the servomotor power/control modules, ensures that the servomotors and the slides remain synchronized throughout the work cycle.

If a slide 18 becomes out-of-sync, discrepancy between the measured position of the slide and the corresponding electronic datum 18*b* at the beginning or end of a workcycle (or whenever a check is effected manually through the operator station keyboard or automatically by PLC programming) will generate an out-of-sync signal to the operator. This condition is corrected by returning the out-of-sync rack slide to a home position corresponding with the electronic datum, and/or zeroing out or recalibrating the electronic datum. Recalibration is accomplished by entering appropriate commands and information at the operator workstation keyboard.

The electronic calibration and synchronization of the present invention eliminates the need for physical determination of datum surfaces and for manually adjusting out-of-sync rack slides and/or regrinding the physical datums when a problem occurs. Moreover, the electronic synchronization of the present invention through the direct drive motor system, particularly using a roller screw drive with shaft angle encoding, allows the electronic datums and the synchronizations of the slides to be carried out more precisely than with any mechanical, hydraulic, or limit switch controlled system known in the art.

The electronic calibration and synchronization of the rack slides in the present invention also eliminates the need for limit switches to prevent overtravel of the rack slides, although limit switches can be provided, if desired, as a backup to the servomotor control over the slides.

While a currently preferred embodiment of the inventive machine has been illustrated above for purposes of explanation, it should be remembered that this is an exemplary embodiment, and is not intended to limit the invention to the specific structure disclosed. It is anticipated that different makes and models of the commercially available motor drive and communication and control components can be used by those skilled in the art. The size and shape of the vertical slide bases and the space frame can vary for different operating requirements; for example, the term "plates used to refer to the structurally tied portions of the vertical slide bases is not intended to be limited to the specific rectangular structure 12*a* of the illustrated embodiment, although generally rectangular, blocklike, symmetrical bodies capable of resting upright on a horizontal support are preferred. The nature of the forming operation and the forming tools used to shape the workpiece can also vary somewhat within what has been referred to as the "spline-forming" art. These are just a few examples of the physical features of the illustrated embodiment which can be replaced or modified with known equivalents, now that we have disclosed our invention, without removing the machine from the scope of that invention. Accordingly, we claim:

In the claims:

1. A spline-forming machine of the type in which spline-forming racks are simultaneously reciprocated across a rotatable workpiece, comprising:

a pair of vertical slide bases on which the spline-forming racks are adapted to be reciprocated up and down across a workpiece rotating on a workpiece axis extending horizontally between and parallel to the slide bases such that spline-forming forces transverse to the workpiece axis are generated between the slide bases, the slide bases comprising structural plates facing each other from opposite sides of the workpiece axis, the plates being structurally connected and pre-tensioned relative to one another by upper and lower pairs of tensioned tie bars symmetrically bracketing the workpiece above and below the workpiece axis, respectively, such that the pre-tensioned slide bases deflect in parallel in response to the spline-forming forces to maintain the spline-forming forces centered on the workpiece.

2. The machine of claim 1, wherein each slide base comprises a structural plate portion adapted to receive an end of a tie bar, and upper and lower slide supports extending vertically from the structural plate portion.

3. The machine of claim 2, wherein the slide supports each comprise a pair of spaced parallel supports each capable of supporting a slide rail.

4. The machine of claim 2, wherein the structural plate portion of each slide base has a lower edge with a width adapted to rest the machine upright on a horizontal frame.

5. The machine of claim 4, wherein the lower slide support extends downwardly from an inside portion of the lower edge of the structural plate, leaving an outside portion of the lower edge of the structural plate adapted to rest on a horizontal frame member.

6. The machine of claim 2, wherein the tie bars comprise a central stud with a screw end secured to one plate and a nut end secured to the opposite plate by a pre-tensioning nut, and a sleeve over the central stud and extending between opposing faces of the plates.

7. The machine of claim 1, further including a space frame comprising frame members joined to form a support on which the slide bases can be rested and secured in a vertical position, wherein the tie bars contain the spline-forming forces generated between the vertical slide bases by the spline-forming racks independently of the space frame.

8. The machine of claim 7, wherein the space frame includes a lift attachment at which the space frame can be connected to a lifting device for moving the space frame to a different location.

9. The machine of claim 7, wherein the space frame comprises hollow frame members joined to form a lower frame portion including horizontal frame members on which lower edges of the slide base structural plates rest, and an upper frame portion capable of being secured to upper edges of the machine structural plates.

10. The machine of claim 9, wherein the space frame includes a rear access frame portion partially enclosing a rear face of the machine.

11. The machine of claim 10, wherein the rear access frame portion includes a doorway type rear opening on which an electrical panel for the machine is mounted as a door to selectively limit access to the rear of the machine.

12. The machine of claim 1, wherein the upper and lower pairs of tensioned tie bars orthogonally bracket the workpiece above and below the workpiece axis.

13. The machine of claim 2, wherein the upper and lower slide supports are symmetrically arranged above and below the structural plate portion of each slide base, such that the structural plate portion forms the center of each slide base.

14. The machine of claim 2, wherein the slide bases are substantially identical in shape.

15. The machine of claim 1, further including a drive device associated with each slide base, the drive device adapted to reciprocate a spline-forming rack on its slide base, wherein the drive device is mounted directly on top of the slide base in longitudinal alignment therewith.

16. The machine of claim 15, wherein the drive device on each slide base is structurally independent of the drive device on the other slide base.

17. A spline-forming machine of the type in which spline-forming racks are simultaneously reciprocated across a rotatable workpiece, comprising:

a pair of substantially identical, vertical slide bases, each slide base comprising a massive, block-like structural plate portion and upper and lower slide supports extending vertically from upper and lower faces of the structural plate portion, each slide base being symmetrical with the structural plate portion centered on the slide base;

upper and lower pairs of tensioned tie bars structurally connecting and pre-tensioning the structural plate portions of the slide bases relative to one another, the tensioned tie bars being arranged to symmetrically and orthogonally bracket a workpiece centered between the structural plate portions on a horizontal axis extending between and parallel to the slide bases, such that the pre-tensioned slide bases deflect in parallel in response to spline-forming forces generated by spline-forming racks acting on the workpiece, thereby maintaining the spline-forming forces centered on the workpiece.

18. A spline-forming machine of the type in which spline-forming racks are simultaneously reciprocated across a rotatable workpiece, comprising:

a pair of vertical slide bases structurally connected and pre-tensioned relative to one another by a plurality of transverse, tensioned tie bars arranged symmetrically around a workpiece-forming location centered between the slide bases at which spline-forming forces are generated by spline-forming racks on the slide bases, the tie bars being tensioned such that the slide bases deflect in parallel in response to the spline-forming forces to maintain the spline-forming forces centered on the workpiece.

19. The machine of claim 18, wherein each slide base includes a spline-forming rack and a drive device adapted to reciprocate the spline-forming rack up and down, wherein the drive device is mounted on the slide base on an upper end thereof independently of the drive device on the other slide base.

20. The machine of claim 19, wherein each drive device is mounted in longitudinal alignment with the slide base.

* * * * *

UNITED STATES PATENT AND TRADEMARK OFFICE

CERTIFICATE OF CORRECTION

PATENT NO : 5,950,471

DATED : September 14, 1999

INVENTOR(S) : Everlove

It is certified that error appears in the above-identified patent and that said Letters Patent is hereby corrected as shown below:

Column 3, lines 53, change "slides" to --slide--.

Column 4, line 35, after "drive mechanisms discussed below." insert the following sentences --It will be understood by those skilled in the art that the illustration of the lefthand slide base 12 has been simplified in the drawings of Figures 1 and 1A by omitting the upper and lower rail supports 12b, for clarity's sake. Rail supports 12b are shown on the lefthand slide base in the perspective view of Figure 2.--

Column 4, line 48, change "operation" to --operations--.

Column 5, line 35, after "slide" (first occurrence) insert --18--.

Column 8, line 20, replace "mechanic" with --machine--.

Column 8, line 23, change "drive" to --drives--.

Column 8, line 30, after "device" delete "36'".

Column 8, line 31, after "36c" insert --(Figure 1A)-- and before "in the drawings" insert --(Figure 4A)--.

Column 9, line 29, replace "data" with --datum--.

Column 9, line 38, change "18a" to --18b--.

Column 9, line 58, before "physical datums" delete "the".

Column 9, lines 62-63, change "synchronizations" to --synchronization--.

UNITED STATES PATENT AND TRADEMARK OFFICE

CERTIFICATE OF CORRECTION

PATENT NO : 5,950,471

DATED : September 14, 1999

INVENTOR(S) : Everlove

It is certified that error appears in the above-identified patent and that said Letters Patent is hereby corrected as shown below:

Column 10, line 13, change " "plates" to --"plates"--.

Column 10, line 49, after "from" insert --upper and lower portions, respectively, of--.

Column 11, line 32, before "drive device" replace "the" with --each--.

Column 11, line 34, before "drive device" replace "the" with --each--.

Column 11, line 35, before "slide base" replace "the" with --its--.

Column 12, line 4, replace "faces" with --ends--.

Column 12, line 6, replace "with" with --such that-- and before "centered" insert --is--.

Column 12, line 17, after "spline-forming racks" insert --on the slide bases--.

Signed and Sealed this

Twenty-ninth Day of August, 2000

*Attest:*

*Attesting Officer*

Q. TODD DICKINSON

*Director of Patents and Trademarks*